US005591081A

United States Patent [19]

Suzuki

[11] Patent Number: 5,591,081

[45] Date of Patent: Jan. 7, 1997

[54] CARD GAME AMUSEMENT DEVICE

[75] Inventor: Hirokazu Suzuki, Tokyo, Japan

[73] Assignee: Sigma, Incorporated, Tokyo, Japan

[21] Appl. No.: 359,533

[22] Filed: Dec. 20, 1994

[30] Foreign Application Priority Data

Jan. 13, 1994 [JP] Japan ..... 6-002158

[51] Int. Cl.[6] ..... A63F 1/00

[52] U.S. Cl. ..... 463/13

[58] Field of Search ..... 463/11, 12, 13

[56] References Cited

U.S. PATENT DOCUMENTS 5,019,973 5/1991 Wilcox et al. ..... 463/13

5,437,451 8/1995 Fulton ..... 463/13

*Primary Examiner*—William H. Grieb

*Attorney, Agent, or Firm*—Hickman Beyer & Weaver

[57] ABSTRACT

A card game amusement device simulates a card game in which a card the number or the suit of which matches with a number or a suit of a card displayed on a second screen region of a graphic screen is selected from cards displayed on a first screen region, and in which the card is moved onto the card displayed on the second screen region, and in which selecting and moving a card is repeated until all cards are moved to the second screen region or until a card the number or the suit of which matches with the number or the suit of the card displayed on the second screen region is not present on the first screen region.

20 Claims, 7 Drawing Sheets

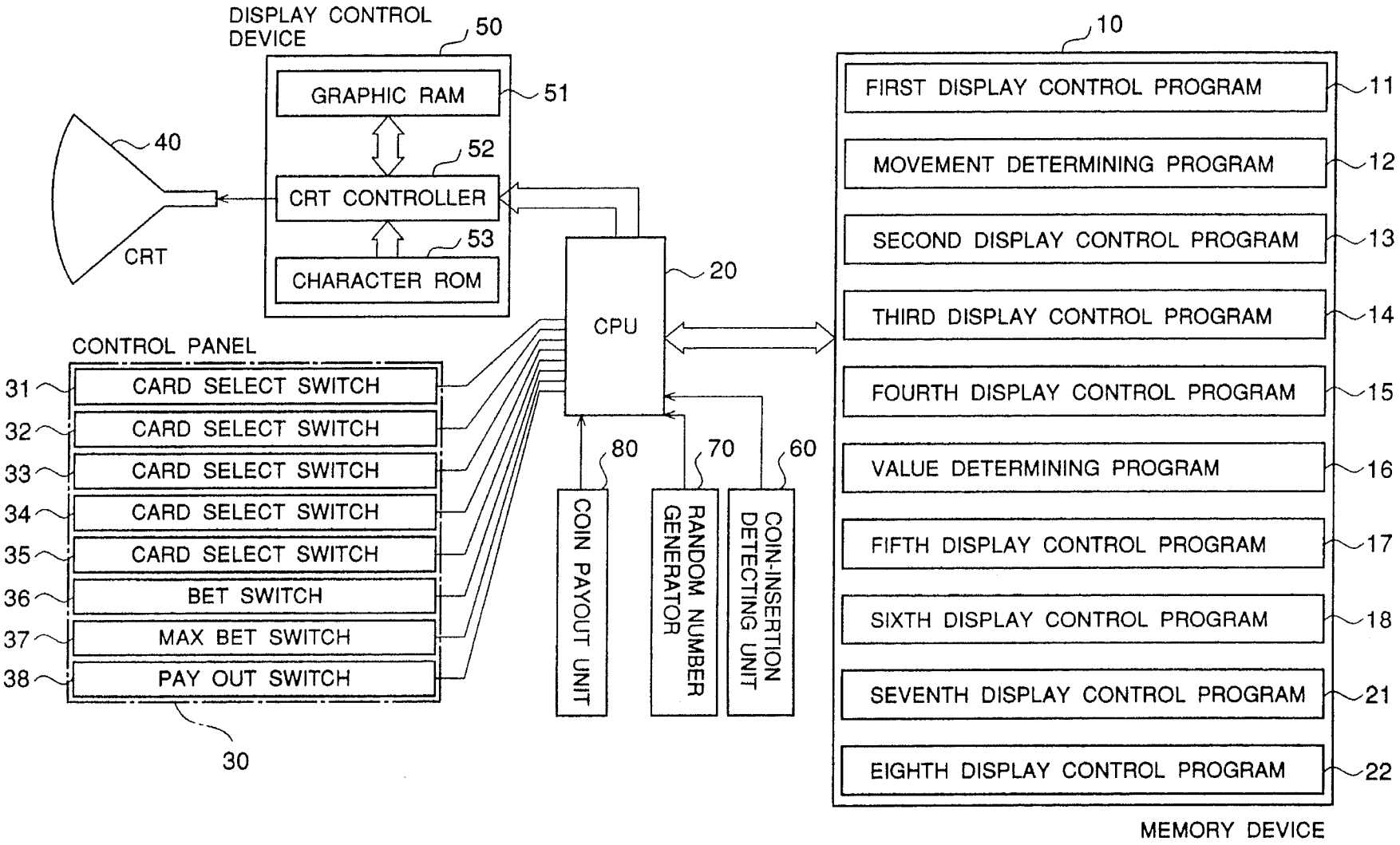
Fig.1
10
11
FIRST DISPLAY CONTROL PROGRAM
12
MOVEMENT DETERMINING PROGRAM
13
SECOND DISPLAY CONTROL PROGRAM
14
THIRD DISPLAY CONTROL PROGRAM
15
FOURTH DISPLAY CONTROL PROGRAM
16
VALUE DETERMINING PROGRAM
17
FIFTH DISPLAY CONTROL PROGRAM
18
SIXTH DISPLAY CONTROL PROGRAM
21
SEVENTH DISPLAY CONTROL PROGRAM
22
EIGHTH DISPLAY CONTROL PROGRAM
MEMORY DEVICE
20
CPU
60
COIN-INSERTION DETECTING UNIT
70
RANDOM NUMBER GENERATOR
80
COIN PAYOUT UNIT
50
DISPLAY CONTROL DEVICE
51
GRAPHIC RAM
52
CRT CONTROLLER
53
CHARACTER ROM
40
CRT
CONTROL PANEL
30
CARD SELECT SWITCH
CARD SELECT SWITCH
CARD SELECT SWITCH
CARD SELECT SWITCH
CARD SELECT SWITCH
BET SWITCH
MAX BET SWITCH
PAY OUT SWITCH
31
32
33
34
35
36
37
38

CARD GAME AMUSEMENT DEVICE

BACKGROUND OF THE INVENTION

1. Field of the Invention

The present invention relates to a card game amusement device which simulates a card game using images of cards displayed on a graphic display device.

2. Related Background Art

Poker game machines to enjoy poker games by oneself are installed in amusement centers. The poker game machine is a device to perform what is called a draw poker game, in which an unnecessary card(s) among five cards displayed on a screen is(are) exchanged with another card(s) and in which from a combination of the obtained cards, the value of hands such as royal flush, full house is made and in which in accordance with a respective bet to the combination, coins or the like are paid out.

As one of references relative to the conventional techniques, there is a Japanese Patent Application No. HEI 1-335959 (335959/1989).

A large number of players play poker games to kill time. However, because the poker game is a simple game and the game is over for a short period of time, there is a problem that the players are not able to kill time as they desire. Further, because of the simple game, a large number of players lose interest in games.

SUMMARY OF THE INVENTION

It is an object of the present invention to provide a card game amusement device to solve such a problem, and to play for a long period of time without losing interest.

In order to solve the above problem, a card game amusement device of the present invention comprises (a) first display controller for selecting a plurality of cards from one deck of playing cards and displaying these cards on a first screen region of a graphic screen, (b) movement determining unit for, when no card is displayed on a second screen region of the graphic screen, determining all of the cards displayed on the first screen region to be moveable cards, and when the card is displayed on the second screen region, checking whether a number or a suit of the card displayed on the second screen region matches with a number or a suit of each card displayed on the first screen region, if they match, determining the matched card on the first screen region to be a moveable card and if they do not match, determining the unmatched card on the first screen region to be an unmovable card, (c) designation receiving unit for, when a player selects a certain card from the cards displayed on the first screen region and determined to be the movable cards by the movement determining unit, receiving the designation of the certain card as a card to be moved, (d) second display controller for eliminating the card to be moved from the first screen region, selecting one card from the deck of the unselected playing cards, displaying the selected card on the first screen region instead of the card to be moved, and displaying the card to be moved on the second screen region, and (e) third display controller for displaying the current number of cards successively displayed on the second screen region by the second display control means on a third screen region.

Further, the card game amusement device may further comprise (f) fourth display controller for displaying a table of the number of cards successively displayed on the second screen region and corresponding scores to be given to the player on a fourth screen region of the graphic screen, and uniquely displaying a position of the current number of cards successively displayed on the second screen region in the table by inverting, stressing, or flushing the position.

Furthermore, the number of the cards to be displayed on the first screen region of the graphic screen by the first display controller is five, and the card game amusement device may further comprise (g) value determining unit for determining whether the five cards form the hand in poker, and (h) fifth display controller for displaying a table of a plurality of kinds of hands in poker, corresponding scores to be given to the player, and frequency of the values made on a fifth screen region of the graphic screen, and when the value determining unit determines that the hand in poker is made, displaying the frequency of values made on a frequency-display column corresponding to the value in the table.

The card game amusement device of the present invention is an amusement device for simulating a card game which performs designating a card the number or the suit of which matches with a number (A (ace), 2, 3, . . . or K (king)) or a suit (spades, hearts, diamonds or clubs) of a card displayed on a second screen region of a graphic screen from cards displayed on a first screen region, and moving the designated card onto a card displayed on the second screen region are repeated until all cards are moved onto the second screen region or until the number or suit of each card displayed on the first screen region matches with neither the number nor suit of the card displayed on the second screen region. In particular, images of a plurality of cards selected from one deck of playing cards are displayed on the first screen region of the graphic screen by first display controller. An image of a predetermined card is displayed on the second screen region by second display controller. Next, movement determining unit determines whether the cards displayed on the first screen region are movable cards. That is, when the card is not displayed on the second screen region, the cards displayed on the first screen region are determined to be movable cards without any conditions. When the card is displayed on the second screen region, the number or the suit of the card which matches with either the number or the suit of the card displayed on the second screen region is determined to be a movable card and the unmatched card is determined to be an unmovable card.

As a player who has seen the graphic screen designates one card from the cards which are displayed on the first screen region and determined to be the moveable cards by the movement determining unit, the second display controller eliminates an image of the card to be moved displayed on the first screen region. Then, one of cards which have not been selected yet is selected and this card is displayed on the first screen region instead of the card to be moved. The image of the card to be moved is displayed on the second screen region of the graphic screen. Since the images are displayed in this manner, it seems to the players as if the card designated by herself/himself is moved from the first screen region to the second region and the new card is filled the vacancy of the first screen region.

The third display controller displays the current number of cards on the third screen region, which is successively displayed on the second screen region. With this display, the player easily knows how many cards are remained in the first screen region.

The fourth display controller displays a table of the number of cards successively displayed on the second display region and the scores to be given to players on the fourth screen region of the graphic screen. The position corresponding to the current number of cards in the table is uniquely displayed by inverting, stressing or flushing the position. Therefore, a player enjoys playing a game in which cards are moved from a first region to a second region while expecting a score to be obtained.

Furthermore, when the number of cards to be displayed on the first region is five, a poker game is played using these five cards. In other words, every time one of the five cards displayed on the first screen region is eliminated and another card is displayed thereon, the value determining unit determines whether these five cards form the hand in poker. Then, when it determines that the hand in poker is made, the fifth display controller displays a table of the hands in poker and scores to be given to players on the fifth display region. Also, a frequency of values made is displayed in this table. As described above, the essence of the poker game is added to the game in which cards are moved, so that players keep playing games without diminishing interest.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a block diagram showing a configuration of a card game amusement device according to the present embodiment.

DESCRIPTION OF THE PREFERRED EMBODIMENT

Figure 2:
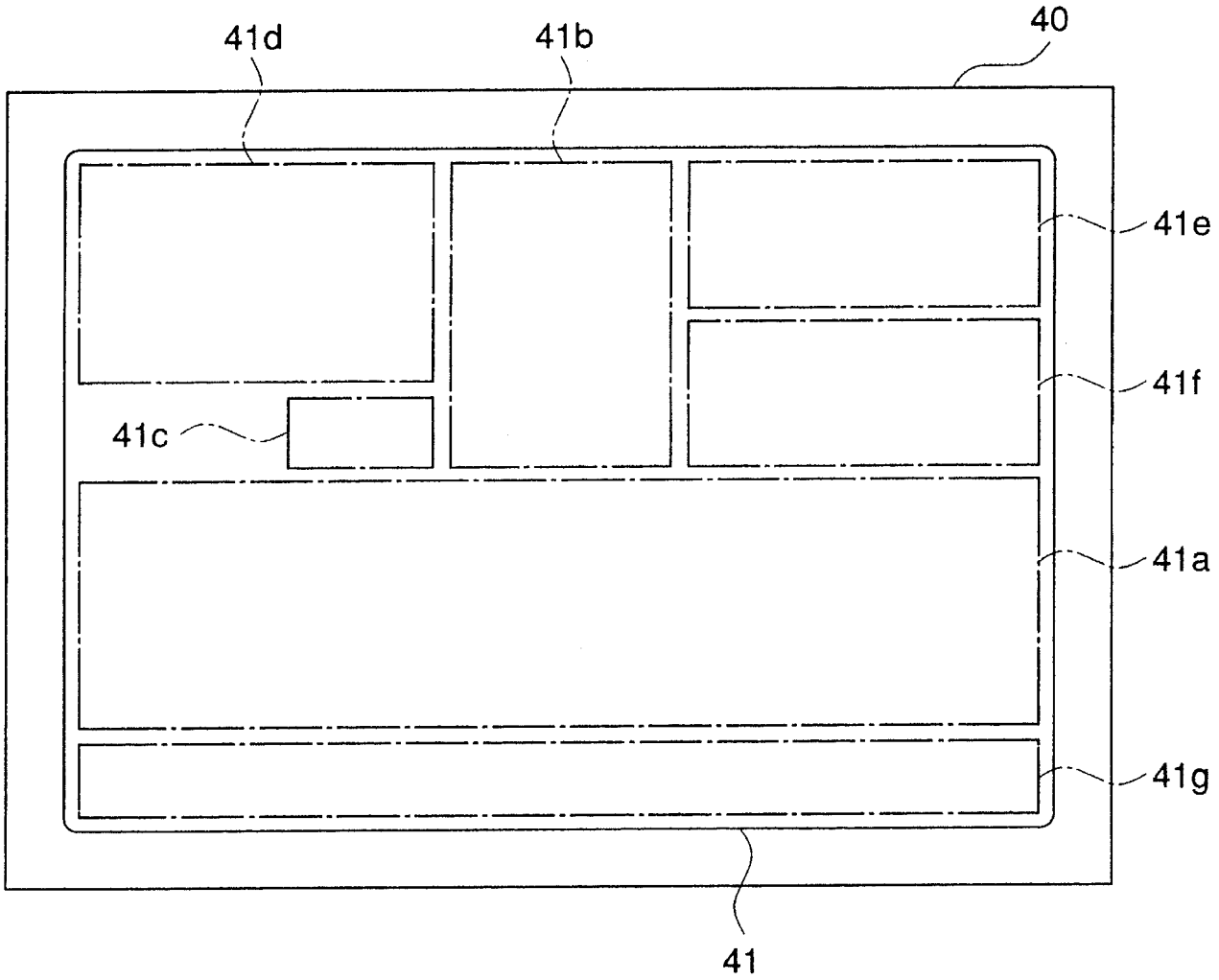
FIG. 2 is a view showing an example of screen division of a display screen of a CRT.

One embodiment of the present invention will be described with reference to the accompanying drawings below. FIG. 1 a block diagram showing a configuration of a card game amusement device according to the present embodiment. Referring to FIG. 1, the card game amusement device of the present embodiment comprises a memory device 10 in which every processing program is stored, a CPU 20 for controlling operations of the processing programs, and a control panel 30 with every switch arranged. The card game amusement device further comprises a CRT 40 for displaying images of cards, a display control device 50 for controlling the display of the CRT 40, a coin-insertion detecting unit 60 for detecting the insertion of a coin, a random number generator 70 for generating a random number, and a coin payout unit 80 for paying out coins.

The display control device 50 comprises a CRT controller 52 for controlling the display of images to the CRT 40, a graphic RAM 51 for temporarily storing graphic data to be sent to the CRT 40, and a character ROM 53 in which character data are stored. As shown in FIG. 2, a display screen 41 of the CRT 40 is divided into screen regions 41*a* through 41*g* by the CRT controller 52.

There are a first display control program (first display control means), a second display control program (second display control means), a third display control program (third display control means), a fourth display control program (fourth display control means), a fifth display control program (fifth display control means), a sixth display control program (sixth display control means), a seventh display control program (seventh display control means), and an eighth display control program (eighth display control means), stored in the memory device 10.

The first display control program displays five cards on the screen region 41*a* (first screen region) of the CRT 40. The second display control program 13 displays a predetermined card on the screen region 41*b* (second screen region) of the CRT 40. The third display control program 14 displays the number of cards successively displayed on the screen region 41*b* on the screen region 41*c* (third screen region). The fourth display control program 15 displays a table of the number of cards successively displayed on the screen region 41*b*, and corresponding scores to be given to players on the screen region 41*d* (fourth display region). The fifth display control program 17 displays a table of a plurality of kinds of hands in poker on the screen region 41*e* (fifth screen region). The sixth display control program 18 displays cards currently displayed on the screen region 41*a* with boldface, cards not displayed thereon with lightface, and displays cards the number or the suit of which is the same as the number or the suit of the card currently displayed on the screen region 41*b* by surrounding with lines, on the screen region 41*f* (sixth screen region). The seventh display control program 24 displays a bet on the screen region 41*g* (seventh screen region). The eighth display control program displays a symbol, or characters (e.g., SELECTABLE) for specifying cards movable from the screen region 41*a* to the screen region 41*b*, on the screen region 41*g* (eight screen region) located under the cards displayed on the display region 41*a*.

There are a movement determining program 12 for determining whether a card is moveable and a value determining program 16 for determining whether the plural cards displayed on the screen region 41*a* of the CRT 40 form the hand in poker, stored in the memory device 10.

Switches 31 through 35 for selecting one card from five cards displayed on the screen region 41*a*, a switch 36 for entering a bet, a switch 37 for entering a maximum bet, and a switch 38 for requesting a payment of coins are provided on the control panel 30. Here, every time the switch 36 is pressed, the bet becomes high in order, twice, third time and so on, and the switch 37 is a switch to make a bet to the maximum bet (e.g., 10 times) with one press.

Figure 3:
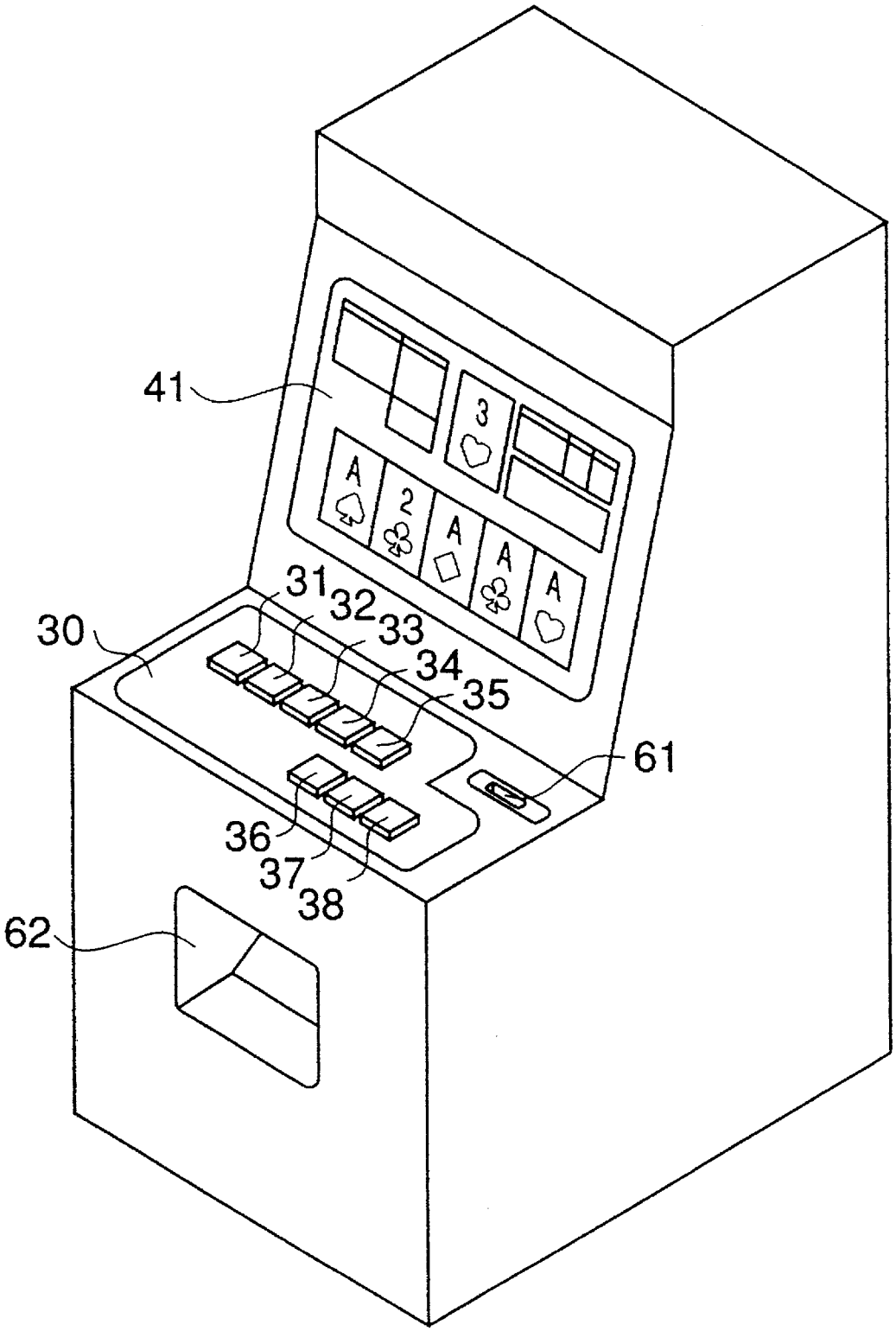
FIG. 3 is a perspective view showing an appearance of a card game amusement device according to the present embodiment.

The present embodiment has an external appearance shown in FIG. 3. Referring to FIG. 3, the card game amusement device of the present embodiment comprises the display screen 41 for displaying cards and others, a coin slot 61 through which a coin is to be inserted, the control panel 30 with the switches 31 through 38 arranged, and a coin payout opening 62 for paying out coins in accordance with allotment. During game, images such as ones shown in FIG. 4 through FIG. 10 are displayed on the display screen 41. When a coin is inserted through the coin slot 61, the coin insertion detecting unit 60 detects a fact of the insertion and the number of inserted coins and transmits them to a CPU 20. The coin payout unit 80 pays out a specified number of coins from the coin payout opening 62 in accordance with an instruction of the CPU 20.

Next, referring to FIG. 4 through FIG. 10, the operation of the card game amusement device of the present embodiment and a method for playing with the device will be described.

Figure 4:
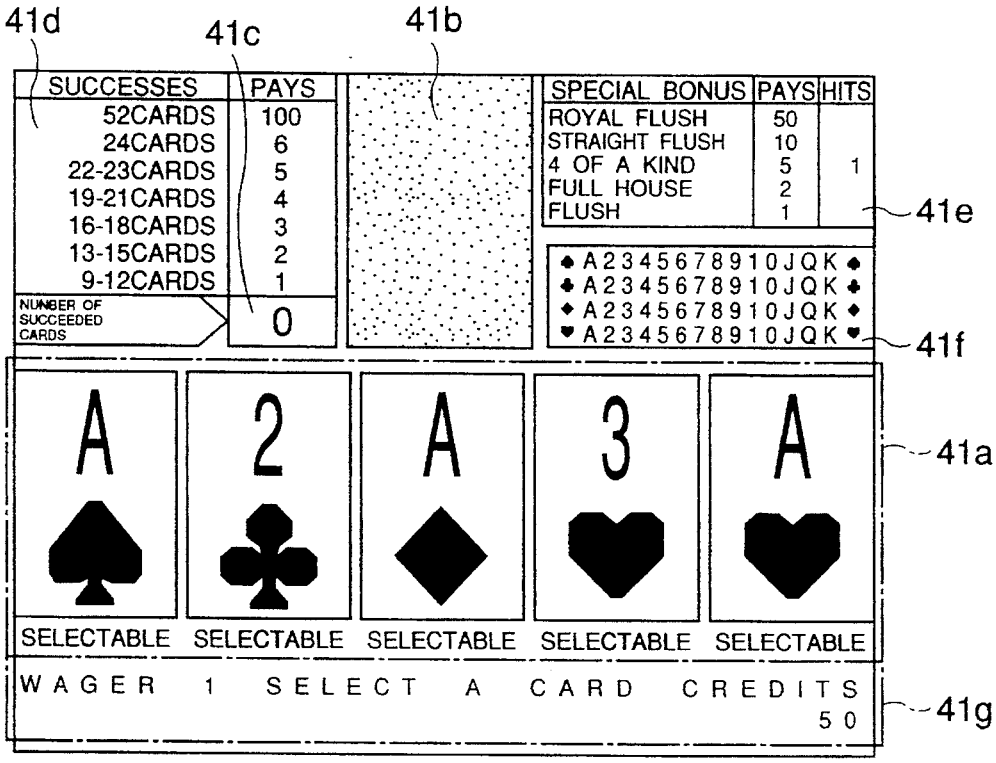
FIGS. 4 to 10 are views showing an example of an image to be displayed on a CRT, which is changed as a game proceeds.

First, as a player inserts a coin or coins through the coin slot 61, the coin insertion detecting unit 60 transmits a signal indicating the insertion of the coin(s) and a signal indicating the number of inserted coins to the CPU 20. Next, the CPU 20 runs the first display control program 11 through the sixth display control program 18 to display an initial image shown in FIG. 4 on the CRT 40. In the initial image, as shown in FIG. 4, predetermined five cards are selected from 52 playing cards by the random number generator 70 and displayed on the screen region 41*a* in a row. With the initial condition, any of five cards can be moved onto the screen region 41*b*, so that "SELECTABLE" is displayed under every card. Only a background image is displayed on the screen region 41*b*, and the number of cards succeeded in movement from the screen region 41*a* to the screen region 41*b*, which is "0", is displayed on the screen region 41*c*. A table of the number of coins to be paid for 9 to 52 movement-succeeded cards is displayed on the screen region 41*d*, and a table of the values of hands in poker and the number of coins to be paid is displayed on the screen region 41*e*. The number of coins to be paid is determined as the player presses the switches 37 and 38 which are for determining bets. The current bet is displayed on the screen region 41*g* as "WAGER". The hands in poker to be used are "ROYAL FLUSH", "STRAIGHT FLUSH", "FOUR OF A KIND", "FULL HOUSE" and "FLUSH". "ONE PAIR", "TWO PAIRS" and the other hands are not to be the subjects of scores because they are made easily. Therefore, the five cards displayed on the screen region 41*a* forms the hand of "THREE OF A CARD" but nothing is displayed in a column "HIT" of the screen region 41*e*. Further, the five cards displayed on the screen region 41*a* are displayed on the screen region 41*f* with boldface and the remaining cards are displayed with lightface.

Next, as the player selects a card of "three of hearts" from the five cards displayed on the screen region 41*a* and presses the switch 34 corresponding to this card, a signal indicating that this card is to be moved onto the screen region 41*b* is transmitted to the CPU 20. The CPU 20 runs the first display control program 11 to eliminate the card of "three of hearts" from the display region 41*a*. Then, a new card (ace of clubs) selected by the random generator 70 is displayed on the same region. Further, the CPU 20 runs the second display control program 13 to display the card of "three of hearts" on the screen region 41*b*.

Furthermore, the CPU 20 runs the third display control program 14 through the sixth display control program 18. As a result, "1" as the number of movement-succeeded cards is displayed on the screen region 41*c*, and the number of successes, "1", is displayed in a column "HIT" corresponding to "4 of a kind" on the screen region 41*e*. The display of "three of hearts" is eliminated from the screen region 41*f* and lines are displayed thereon in crosswise directions with the position of "three of hearts" centered. The lines are to surround all possible cards to be piled up on the card of "three of hearts" displayed on the screen region 41*b*. The cards displayed on the screen region 41*a* are displayed on the screen region 41*f* with boldface, so that it is known that the card which is surrounded by the lines and displayed with boldface is a movable card next time.

Figure 5:
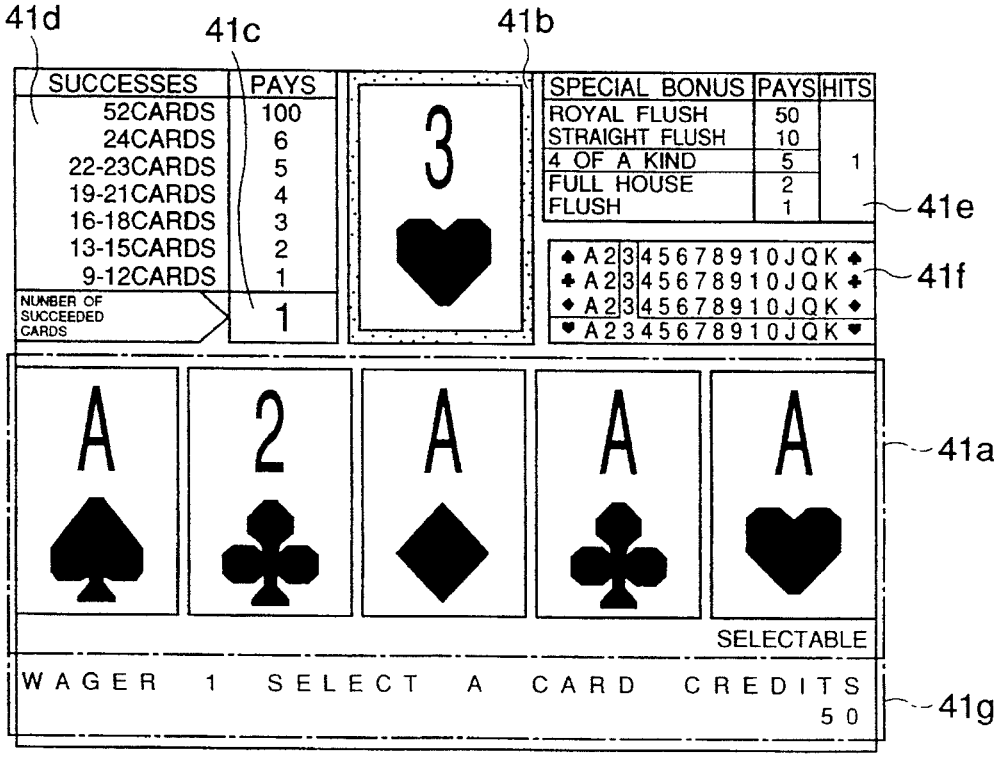

The CPU 20 runs the movement determining program 12 to determine whether any of the five cards displayed on the screen region 41*a* has the same number (3) or the same suit (hearts) as the card of "three of hearts" displayed on the screen region 41*b*. As a result, the card of "ace of hearts" is determined to be a moveable card and "SELECTABLE" is displayed under this card. With the above processes, the image shown in FIG. 5 is displayed on the CRT 40.

Next, as the player selects a card of "ace of hearts" which is denoted with "SELECTABLE" and presses the switch 35 corresponding to this card, a signal indicating that this card is to be moved onto the screen region 41*b* is transmitted to the CPU 20. The CPU 20 runs the first display control program 11 to eliminate the card of "ace of hearts" from the display region 41*a*. Then, a new card (10 of diamonds) selected by the random generator 70 is displayed on the same region. Further, the CPU 20 runs the second display control program 13 to display the card of "ace of hearts" on the screen region 41*b*.

Furthermore, the CPU 20 runs the third display control program 14 through the sixth display control program 18. As a result, "2" as the number of movement-succeeded cards is displayed on the screen region 41*c*. The display of "ace of hearts" is eliminated from the screen region 41*f* and lines are displayed thereon in crosswise directions with the position of "ace of hearts" centered.

Figure 6:
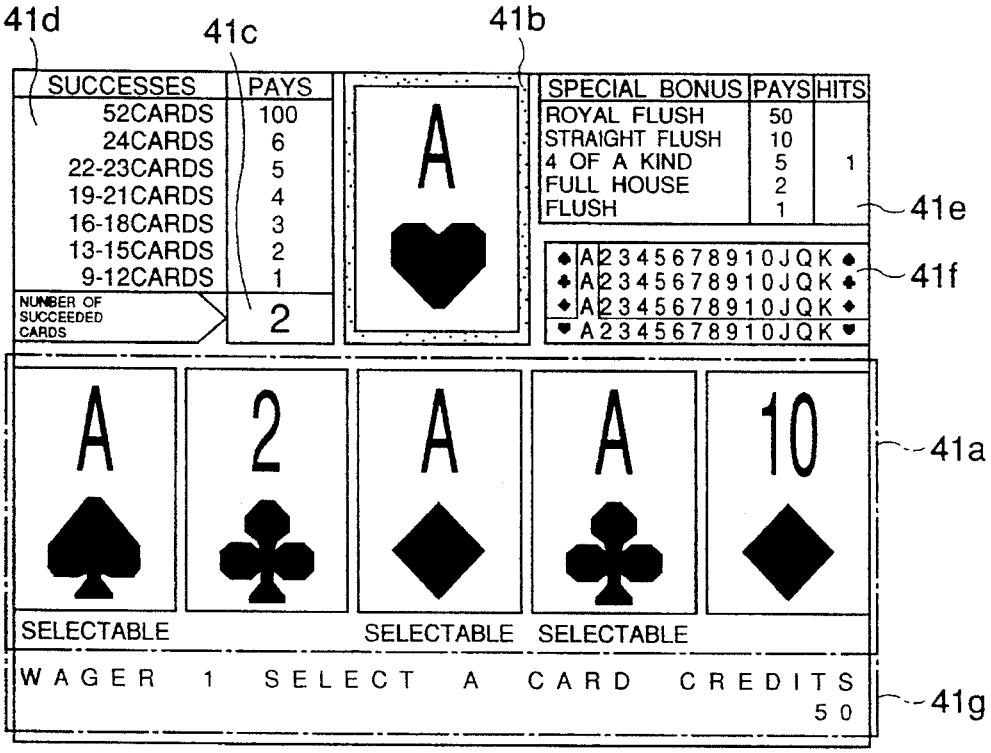

The CPU 20 runs the movement determining program 12 to determine whether any of the five cards displayed on the screen region 41*a* has the same number (ace) or the same suit (hearts) as the card of "ace of hearts" displayed on the screen region 41*b*. As a result, the cards of "ace of spades", "ace of diamonds" and "ace of clubs" are determined to be moveable cards and "SELECTABLE" is displayed under each of these cards. With the above processes, the image shown in FIG. 6 is displayed on the CRT 40.

Next, as the player selects a card of "ace of clubs" from the three cards denoted with "SELECTABLE" and presses the switch 34 corresponding to this card, a signal indicating that this card is to be moved onto the screen region 41*b* is transmitted to the CPU 20. The CPU 20 runs the first display control program 11 to eliminate the card of "ace of clubs" from the display region 41*a*. Then, a new card (10 of hearts) selected by the random generator 70 is displayed on the same region. Further, the CPU 20 runs the second display control program 13 to display the card of "ace of clubs" on the screen region 41*b*.

Furthermore, the CPU 20 runs the third display control program 14 through the sixth display control program 18. As a result, "3" as the number of movement-succeeded cards is displayed on the screen region 41*c*. The display of "ace of clubs" is eliminated from the screen region 41*f* and lines are displayed thereon in crosswise directions with the position of "ace of clubs" centered.

Figure 7:
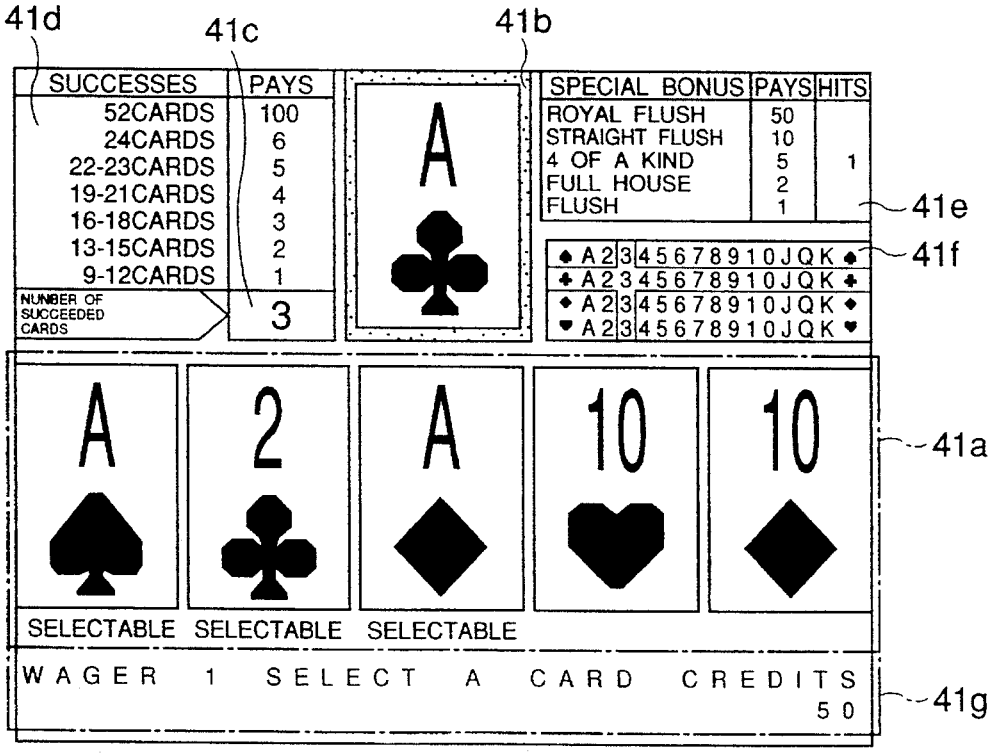

The CPU 20 runs the movement determining program 12 to determine whether any of the five cards displayed on the screen region 41*a* has the same number (ace) or the same suit (clubs) as the card of "ace of clubs" displayed on the screen region 41*b*. As a result, the cards of "ace of spades", "two of clubs" and "ace of clubs" are determined to be moveable cards and "SELECTABLE" is displayed under each of these cards. With the above processes, the image shown in FIG. 7 is displayed on the CRT 40.

Next, as the player selects a card of "two of clubs" from the three cards denoted with "SELECTABLE" and presses the switch 32 corresponding to this card, a signal indicating that this card is to be moved onto the screen region 41*b* is transmitted to the CPU 20. The CPU 20 runs the first display control program 11 to eliminate the card of "two of clubs" from the display region 41*a*. Then, a new card (10 of clubs) selected by the random generator 70 is displayed on the same region. Further, the CPU 20 runs the second display control program 13 to display the card of "two of clubs" on the screen region 41*b*.

Furthermore, the CPU 20 runs the third display control program 14 through the sixth display control program 18. As a result, "4" as the number of movement-succeeded cards is displayed on the screen region 41*c*, and the number of successes, "1", is displayed in a column "HIT" corresponding to "FULL HOUSE" on the screen region 41*e*. The display of "two of clubs" is eliminated from the screen region 41*f* and lines are displayed thereon in crosswise directions with the position of "two of clubs" centered.

Figure 8:
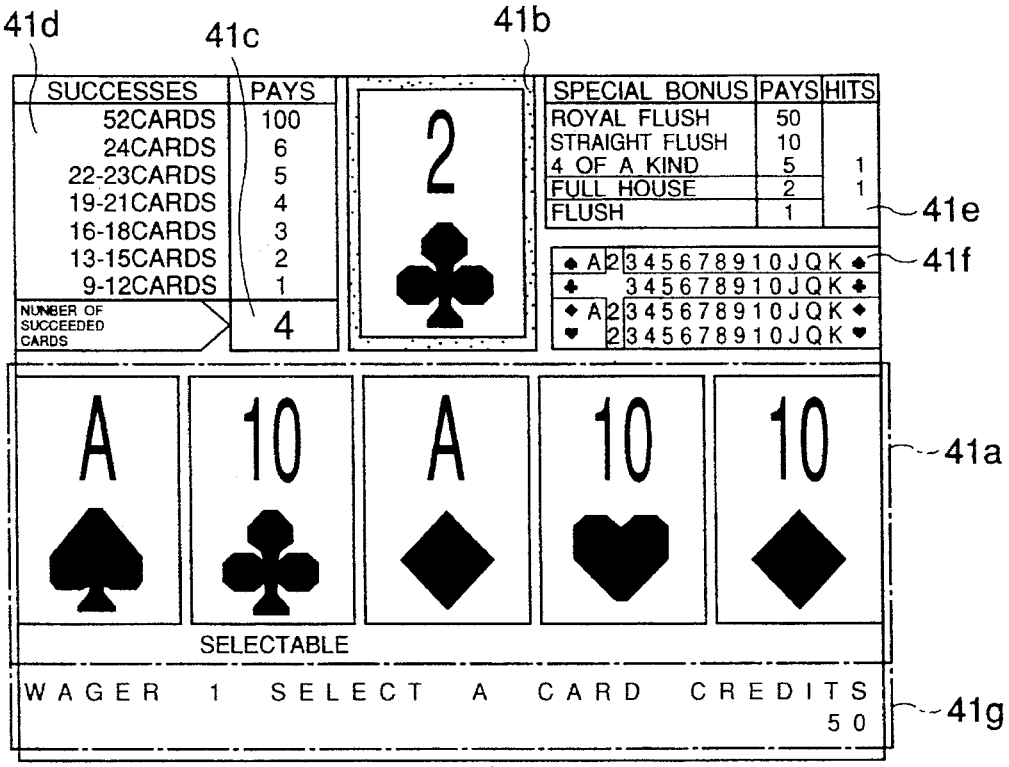

The CPU 20 runs the movement determining program 12 to determine whether any of the five cards displayed on the screen region 41*a* has the same number (two) or the same suit (clubs) as the card of "two of clubs" displayed on the screen region 41*b*. As a result, the card of "ten of clubs" is determined to be a moveable card and "SELECTABLE" is displayed under this card. With the above processes, the image shown in FIG. 8 is displayed on the CRT 40.

Figure 9:
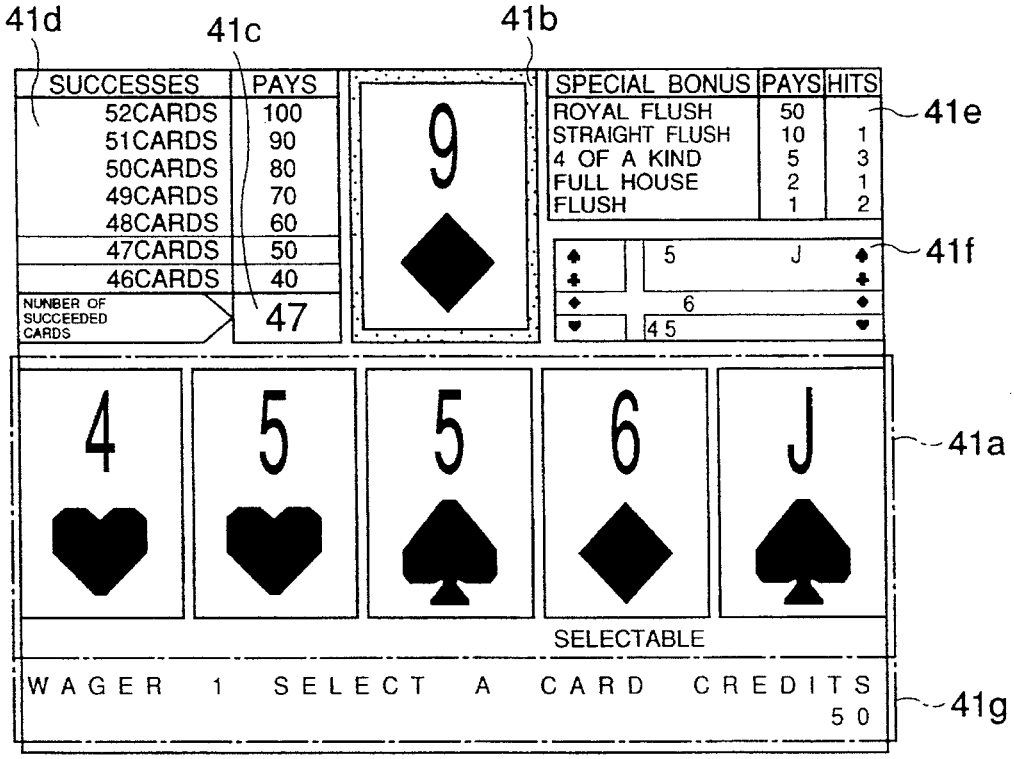

Thereafter, the player keeps selecting cards. The display on the CRT 40 when the movement of 47 cards is completed is shown in FIG. 9. It is known from the display on the screen region 41*c* that the number of movement-succeeded cards is "47". The number of coins to be paid for the 46 to 52 movement-succeeded cards is depicted in the table displayed on the screen region 41*d*, and the position of 47 cards of the current number of movement-succeeded cards is inversely displayed. It is known from the display on the screen region 41*e* that "STRAIGHT FLUSH" has been made once; "FOUR OF A KIND", three times; "FULL HOUSE", once; and "FLUSH", twice up to now.

Next, as the player selects a card of "six of diamonds" Which is denoted with "SELECTABLE" and presses the switch 34 corresponding to this card, a signal indicating that this card is to be moved onto the screen region 41*b* is transmitted to the CPU 20. The CPU 20 runs the first display control program 11 to eliminate the card of "six of diamonds" from the display region 41*a*. Since the 52 cards are already displayed, any card is not displayed on the region from which the "six of diamonds" has been eliminated. Further, the CPU 20 runs the second display control program 13 to display the card of "six of diamonds" on the screen region 41*b*.

Furthermore, the CPU 20 runs the third display control program 14 through the sixth display control program 18. As a result, "48" as the number of movement-succeeded cards is displayed on the screen region 41*c*. The position of 48 cards in the table on the screen region 41*d* is inversely displayed. The display of "six of diamonds" is eliminated from the screen region 41*f* and lines are displayed thereon in crosswise directions with the position of "ace of hearts" centered.

Figure 10:
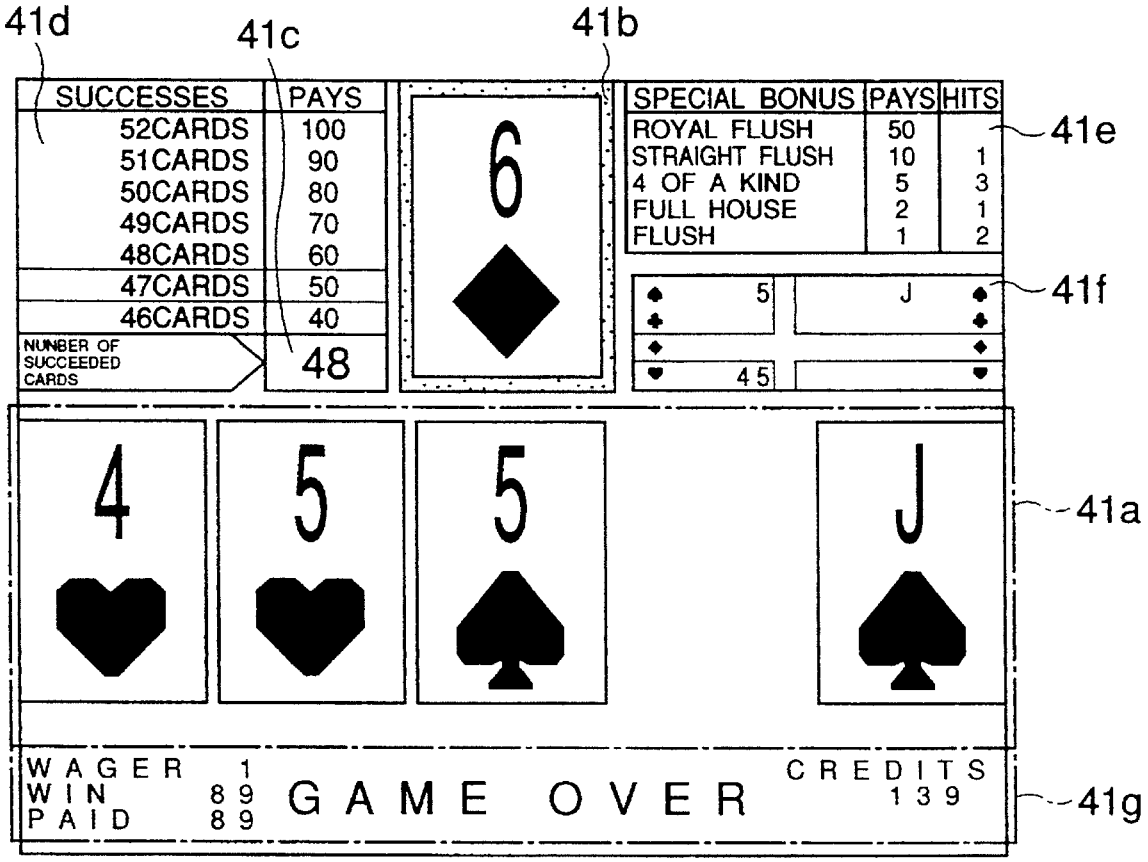

The CPU 20 runs the movement determining program 12 to determine whether any of the four cards displayed on the screen region 41*a* has the same number (six) or the same suit (diamonds) as the card of "six of diamonds" displayed on the screen region 41*b*. As a result, all cards are determined to be unmovable cards and "GAME OVER" is displayed at the center of the screen region 41*g*. The score and the number of coins paid, of the current game are displayed on the left of the screen region 41*g* as "WIN 89" and "PAID 89", respectively. With the above processes, the image shown in FIG. 10 is displayed on the CRT 40.

As described above, when all cards are unmovable, the game is over. The player will select either starting next game or getting coins paid. If the player will start the next game, s/he may add a coin or press the switch 36 or 37. If the player will get the coins paid, he may press the switch 38.

The present invention is not limited to the above embodiment but can be varied in various ways.

For example, in the above embodiment the five cards are displayed in a row on the screen region 41*a* of the CRT 40 but seven cards can be displayed. When the seven cards are displayed, the predetermined five cards are used for the hand in poker. In this case, the number of cards is not limited to seven but can be eight, ten etc. Further, the card may be moved instantly from the screen region 41*a* to the screen region 41*b* or may be glided. The switch corresponding to the moveable card among the switches 31 through 35 can be made to emit so that the selection of the card is easy for players.

Furthermore, the values of hands in poker to be used are not limited to the aforementioned five kinds (Royal Flush, Straight Flush, Four of a kind, Full house and Flush) but three of a kind, two pairs etc. can be the subjects of scores.

Furthermore, in the above embodiment upon the game over, the game score and the number of coins paid are displayed as shown in FIG. 10 but the display is not have to be in this manner. The game score and the number of coins paid can be displayed during the game. In this case, every time the score is obtained, this score is added to the game score. If the score is added to the game score every time the score is obtained, a game process is not interrupted without the display of the column "HITS" on the screen region 41*e*. Therefore, when the method that every time the score is obtained the score is added to the game score is employed, the column "HITS" may not be displayed on the screen region 41*e*.

With the card game amusement device of the present invention, the card game is simulated, in which the card the number or the suit of which matches with that of the card displayed on the second screen region of the graphic screen is selected from the cards displayed on the first screen region, and in which this card is moved onto the card displayed on the second screen region, and in which selecting and moving a card is repeated until all cards are moved onto the second screen region or until a card the number or the suit of which matches with that of the card displayed on the second screen region is not present on the first screen region. Therefore, the players play card games for long period of time without loosing interest.

Further, the essence of the poker game is added to the game in which the cards are moved, so that the players keep playing games with the full of interest.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No. 6-2158 filed on Jan. 13, 1994 is hereby incorporated by reference.

What is claimed is:

1. A card game amusement device simulating a card game to compete how many cards are moved from a first region to a second region on a predetermined graphic screen by arranging a plurality of cards on the first region from one deck of playing cards, designating one card from these plurality of the cards under predetermined conditions, moving the designated card onto said second region and filling a vacancy of said first region with one card from said deck of the playing cards, and repeating moving a card from said first region to said second region and filling said first region with a card until all of said deck of the playing cards are used or until the conditions for selecting the card on said first region are not fulfilled, said card game amusement device comprising:

first display controller for selecting a plurality of cards from one deck of playing cards and displaying these cards on a first screen region of said graphic screen;

movement determining unit for, when no card is displayed on a second screen region of said graphic screen, determining all of the cards displayed on said first screen region to be moveable cards, and when the card is displayed on said second screen region, checking whether a number or a suit of the card displayed on said second screen region matches with a number or a suit of each card displayed on said first screen region, if any of them matches, determining the matched card on said first screen region to be a moveable card and if they do not match, determining the unmatched card on said first screen region to be an unmovable card;

designation receiver for, when a player selects a certain card from the cards displayed on said first screen region and determined to be the movable cards by said movement determining means, receiving the designation of the certain card as a card to be moved;

second display controller for eliminating said card to be moved from said first screen region, selecting one card from said deck of the unselected playing cards, displaying the selected card on said first screen region instead of said card to be moved, and displaying said card to be moved on said second screen region; and third display controller for displaying the current number of cards successively displayed on said second screen region by said second display controller on a third screen region.

2. A card game amusement device according to claim 1 further comprising fourth display controller for displaying a table of the number of cards successively displayed on said second screen region and corresponding scores to be given to the player on a fourth screen region of said graphic screen, and uniquely displaying a position of the current number of cards successively displayed on said second screen region in said table by inverting, stressing, or flushing the position.

3. A card game amusement device according to claim 1, wherein the number of the cards to be displayed on said first screen region of said graphic screen by said first display controller is five; and said card game amusement device further comprises value determining unit for determining whether the five cards form the hand in poker, and fifth display controller for displaying a table of a plurality of kinds of hands in poker, corresponding scores to be given to the player, and frequency of the values made on a fifth screen region of said graphic screen, and when said value determining unit determines that the hand in poker is made, displaying the frequency of the values made on a frequency-display column corresponding to the value in said table.

4. A card game amusement device according to claim 2, wherein the number of the cards to be displayed on said first screen region of said graphic screen by said first display controller is five; and said card game amusement device further comprises value determining unit for determining whether the five cards form the hand in poker, and fifth display controller for displaying a table of a plurality of kinds of hands in poker, corresponding scores to be given to the player, and frequency of the values made on a fifth screen region of said graphic screen, and when said value determining unit determines that the hand in poker is made, displaying the frequency of the values made on a frequency-display column corresponding to the value in said table.

5. A card game amusement device according to claim 1 comprising sixth display controller for displaying on a sixth screen region, cards displayed on said first screen region with boldface, and cards not displayed on said first screen region with lightface.

6. A card game amusement device according to claim 2 comprising sixth display controller for displaying on a sixth screen region, cards displayed on said first screen region with boldface, and cards not displayed on said first screen region with lightface.

7. A card game amusement device according to claim 1 further comprising first switches corresponding to cards displayed on said first screen region, for entering a signal corresponding to the selected card, a second switch for entering a signal indicating a maximum bet, a third switch for requesting a payment of coins, and a control unit for receiving a signal from said first switches, said second switch and said third switch, and sending a control signal to said first display controller, said second display controller, said third display controller, said fourth display controller, said fifth display controller and/or said sixth display controller.

8. A card game amusement device according to claim 2 further comprising first switches corresponding to cards displayed on said first screen region, for entering a signal corresponding to the selected card, a second switch for entering a signal indicating a maximum bet, a third switch for requesting a payment of coins, and a control unit for receiving a signal from said first switches, said second switch and said third switch, and sending a control signal to said first display controller, said second display controller, said third display controller, said fourth display controller, said fifth display controller and/or said sixth display controller.

9. A card game amusement device according to claim 7, wherein said control unit multiplies the bet based on how many times said second switch is pressed in a predetermined time.

10. A card game amusement device according to claim 8, wherein said control unit multiplies the bet based on how many times said second switch is pressed in a predetermined time.

11. A card game amusement device according to claim 1 comprising seventh display controller for displaying a bet on a seventh screen region of said graphic screen.

12. A card game amusement device according to claim 2 comprising seventh display controller for displaying a bet on a seventh screen region of said graphic screen.

13. A card game amusement device according to claim 1 comprising eighth display controller for displaying a symbol or characters for specifying the cards moveable from said first screen region to said second screen region on an eighth screen region of said graphic screen located in a lower region of the cards displayed on said first screen region.

14. A card game amusement device according to claim 2 comprising eighth display controller for displaying a symbol or characters for specifying the cards moveable from said first screen region to said second screen region on an eighth screen region of said graphic screen located in a lower region of the cards displayed on said first screen region.

15. A card game amusement device simulating a card game to compete how many cards are moved from a first region to a second region on a predetermined graphic screen by arranging a plurality of cards on the first region from one deck of playing cards, designating one card from these plurality of the cards under predetermined conditions, moving the designated card onto said second region and filling a vacancy of said first region with one card from said deck of the playing cards, and repeating moving a card from said first region to said second region and filling said first region with a card until all of said deck of the playing cards are used or until the conditions for selecting the card on said first region are not fulfilled, said card game amusement device comprising:

first display control means for selecting a plurality of cards from one deck of playing cards and displaying these cards on a first screen region of said graphic screen;

movement determining means for, when no card is displayed on a second screen region of said graphic screen, determining all of the cards displayed on said first screen region to be moveable cards, and when the card is displayed on said second screen region, checking whether a number or a suit of the card displayed on said second screen region matches with a number or a suit of each card displayed on said first screen region, if any of them matches, determining the matched card on said first screen region to be a moveable card and if they do not match, determining the unmatched card on said first screen region to be an unmovable card;

designation receiving means for, when a player selects a certain card from the cards displayed on said first screen region and determined to be the movable cards by said movement determining means, receiving the designation of the certain card as a card to be moved;

second display control means for eliminating said card to be moved from said first screen region, selecting one card from said deck of the unselected playing cards, displaying the selected card on said first screen region instead of said card to be moved, and displaying said card to be moved on said second screen region; and third display control means for displaying the current number of cards successively displayed on said second screen region by said second display control means on a third screen region.

16. A card game amusement device according to claim 15 further comprising fourth display control means for displaying a table of the number of cards successively displayed on said second screen region and corresponding scores to be given to the player on a fourth screen region of said graphic screen, and uniquely displaying a position of the current number of cards successively displayed on said second screen region in said table by inverting, stressing, or flushing the position.

17. A card game amusement device according to claim 15, wherein the number of the cards to be displayed on said first screen region of said graphic screen by said first display control means is five; and said card game amusement device further comprises value determining means for determining whether the five cards form the hand in poker, and fifth display control means for displaying a table of a plurality of kinds of hands in poker, corresponding scores to be given to the player, and frequency of the values made on a fifth screen region of said graphic screen, and when said value determining means determines that the hand in poker is made, displaying the frequency of the values made on a frequency-display column corresponding to the value in said table.

18. A card game amusement device according to claim 15 comprising sixth display control means for displaying on a sixth screen region, cards displayed on said first screen region with boldface, and cards not displayed on said first screen region with lightface.

19. A card game amusement device according to claim 15 comprising seventh display control means for displaying a bet on a seventh screen region of said graphic screen.

20. A card game amusement device according to claim 15 comprising eighth display control means for displaying a symbol or characters for specifying the cards moveable from said first screen region to said second screen region on an eighth screen region of said graphic screen located in a lower region of the cards displayed on said first screen region.

* * * * *